US009437917B2

(12) United States Patent
Khidre et al.

(10) Patent No.: US 9,437,917 B2
(45) Date of Patent: Sep. 6, 2016

(54) ANTENNA DESIGNS

(71) Applicant: Aruba Networks, Inc., Sunnyvale, CA (US)

(72) Inventors: Ahmed Khidre, Cupertino, CA (US); James W. Jervis, Santa Clara, CA (US); Subburajan Ponnuswamy, Saratoga, CA (US)

(73) Assignee: Aruba Networks, Inc., Sunnyvale, CA (US)

( * ) Notice: Subject to any disclaimer, the term of this patent is extended or adjusted under 35 U.S.C. 154(b) by 98 days.

(21) Appl. No.: 14/471,497

(22) Filed: Aug. 28, 2014

(65) Prior Publication Data

US 2016/0064808 A1 Mar. 3, 2016

(51) Int. Cl.

| | |
|---|---|
| ***H01Q 1/38*** | (2006.01) |
| ***H01Q 1/00*** | (2006.01) |
| ***H01Q 9/04*** | (2006.01) |
| ***H01Q 9/42*** | (2006.01) |
| ***H01Q 21/24*** | (2006.01) |

(52) U.S. Cl.
CPC ..... *H01Q 1/007* (2013.01); *H01Q 9/0421* (2013.01); *H01Q 9/42* (2013.01); *H01Q 21/24* (2013.01)

(58) Field of Classification Search
CPC ..... H01Q 9/32; H01Q 9/0407
USPC ..... 343/700 MS
See application file for complete search history.

(56) References Cited

U.S. PATENT DOCUMENTS

2007/0268183 A1* 11/2007 Stutzke ..... H01Q 9/32 343/700 MS
2010/0045552 A1* 2/2010 Ueki ..... H01Q 1/243 343/745

* cited by examiner

*Primary Examiner* — Graham Smith

(57) ABSTRACT

According to one embodiment of the invention, a network device comprises a plurality of antennas comprising a first antenna, wherein the first antenna comprises: a first set of one or more elements that form an Alford loop and that is configured for electrical excitation via a current transmitted over a conductive medium from a signal source and a second set of one or more elements that is configured for electromagnetic induction without contact with the conductive medium from the signal source.

15 Claims, 7 Drawing Sheets

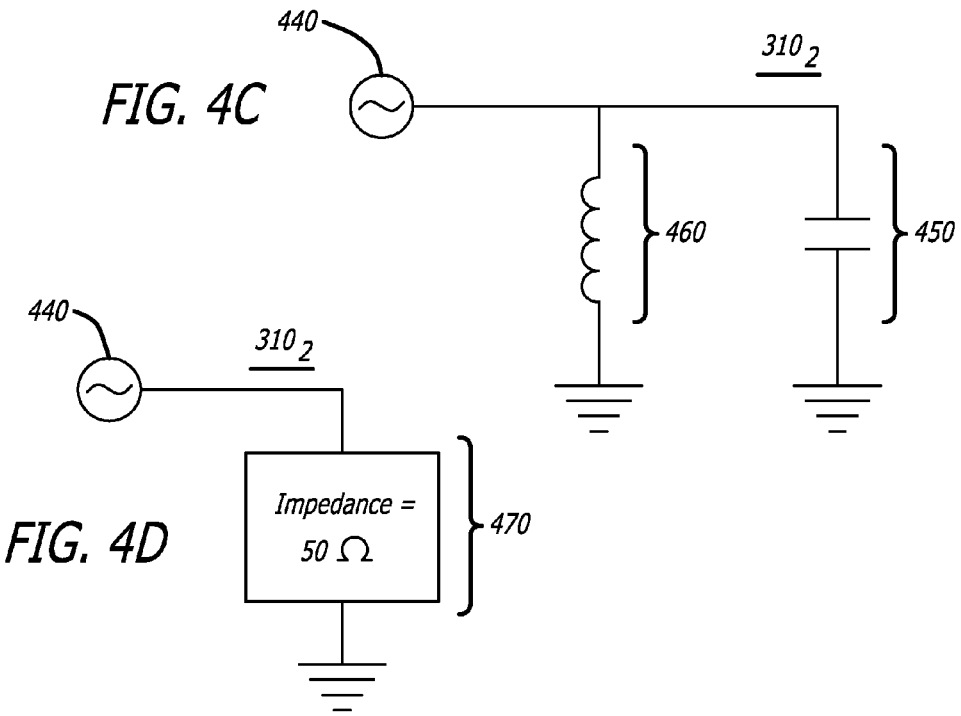
FIG. 4C
FIG. 4D
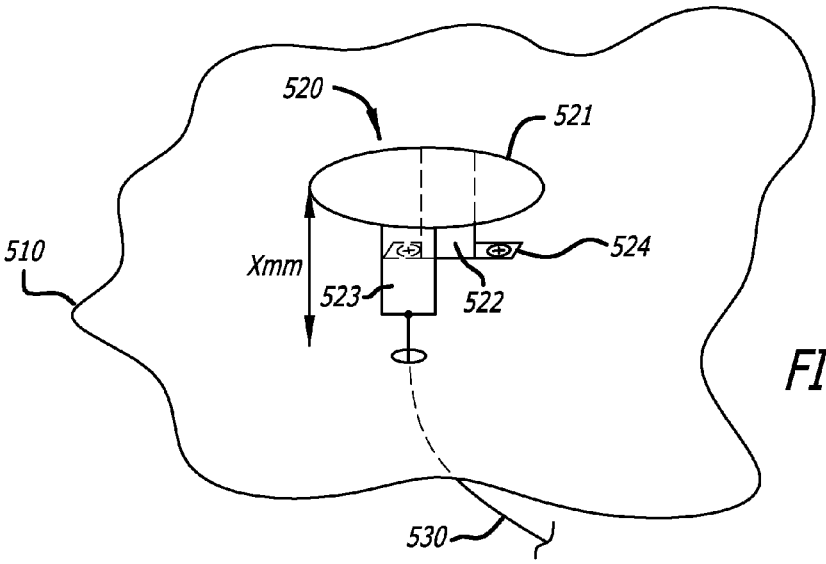
FIG. 5

ANTENNA DESIGNS

FIELD

Embodiments of the disclosure relate to the field of communications, and in particular, to a wireless network device adapted with a low profile antenna configuration for improved performance.

GENERAL BACKGROUND

Over the last decade or so, electronic devices responsible for establishing and maintaining wireless connectivity within a wireless network have increased in complexity. For instance, wireless electronic devices now support greater processing speeds and greater data rates. As a by-product of this increased complexity, radio communications techniques have evolved with the emergence of multiple-input and multiple-output (MIMO) architectures.

In general, MIMO involves the use of multiple antennas operating as transmitters and/or receivers to improve communication performance. Herein, multiple radio channels are used to carry data within radio signals transmitted and/or received via multiple antennas. In comparison with other conventional architectures, MIMO architectures offer significant increases in data throughput and link reliability. MIMO architectures may utilize a "smart" antenna concept requiring multiple sets of antennas, especially for wireless network products such as an Access Point (AP). The use of smart antennas may improve the reliability and performance of MIMO communications, which may be accomplished with polarization diversity (horizontal v. vertical) and/or the spatial diversity (e.g., physical location of the antennas within the AP or beam-forming/beam-switching architectures).

However, one disadvantage of MIMO is that multiple antennas traditionally required more space within the AP, which poses some difficulties as it is preferred for indoor APs to have low visual impact as these devices are generally placed in conspicuous places such as mounted to the ceiling. When design constraints limit the area of the AP, low profile antennas may be used to satisfy one or more design constraints. Low profile antennas are placed within close proximity to a ground plane. When a horizontally, circularly or elliptically polarized antenna and a ground plane operate, possibly in parallel, and within close proximity to each other, the ground plane effectively short circuits the electric field generated by the antenna. This lowers the feedpoint impedance of the antenna, which reduces the efficiency and bandwidth of the antenna. The ground plane also creates an opposing magnetic field that interacts with the magnetic field of the antenna. Therefore, the impact of utilizing a low profile antenna is that the proximity of the ground plane reduces the useful voltage standing wave ratio (VSWR) bandwidth and lowers the efficiency of the antenna.

It would be advantageous if the impact of the proximity of the ground plane to the low profile antenna was negated and therefore did not impact the antenna's performance.

BRIEF DESCRIPTION OF THE DRAWINGS

The disclosure may best be understood by referring to the following description and accompanying drawings that are used to illustrate embodiments of the disclosure.

FIGS. 4B and 4C are exemplary representations of circuit diagrams corresponding to the semi-loop antenna $\mathbf{310}_2$ of FIG. 4A.

FIG. 4D is a second exemplary circuit diagram representing the semi-loop antenna $\mathbf{310}_2$.

FIG. 5 is a perspective view of an alternative exemplary embodiment of the semi-loop antenna $\mathbf{310}_2$ of FIG. 4A.

DETAILED DESCRIPTION

Figure 1:
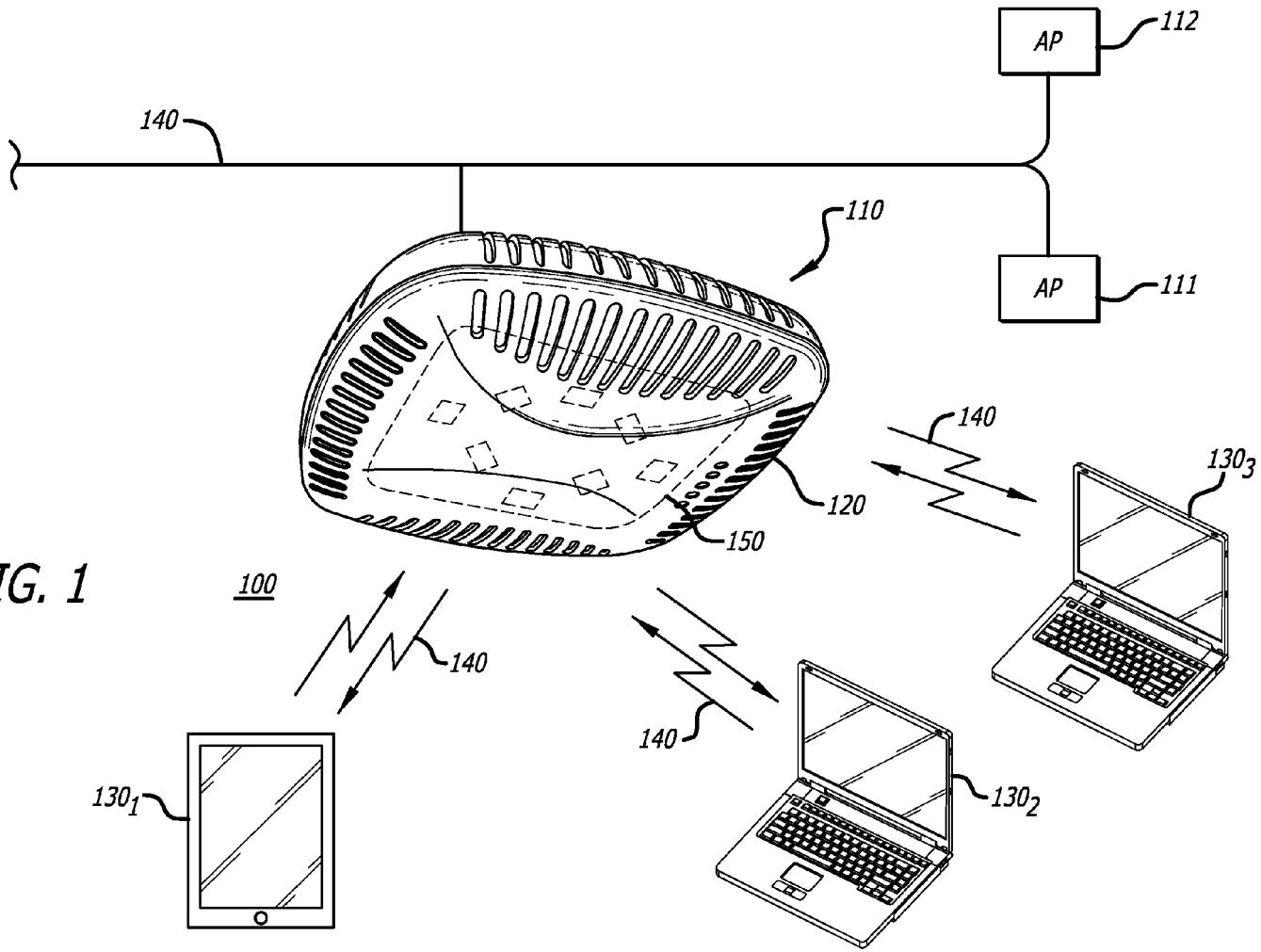
FIG. 1 is an exemplary embodiment of a wireless network including a wireless network device deploying an antenna array assembly.

Embodiments of the disclosure relate to a wireless network device configured with a plurality of low profile antennas, the plurality comprising at least one vertically or elliptically polarized semi-loop antenna including a surface configured to generate capacitance and/or at least one vertically or elliptically polarized monopole antenna including a shunt inductor.

According to one embodiment of the disclosure, an antenna array assembly comprises an antenna array and a substrate (e.g., a ground plane) onto which the antenna array is placed. The "substrate" of the antenna array assembly may comprise a thin layer of conductive material, for example, but not limited or restricted to, copper, silver and/or aluminum. Alternatively, the substrate may comprise a printed circuit board that includes multiple layers of different materials. The "antenna array" may be a collection of low profile antennas including, among others, semi-loop antennas and/or monopole antennas. Throughout the application, unless otherwise stated, the term "semi-loop antenna" should be interpreted as a low profile semi-loop antenna or any low profile antenna operating in a manner similar to a semi-loop antenna. In addition, the term "monopole antenna" should be interpreted as a low profile monopole antenna or any low profile antenna operating in a manner similar to a monopole antenna. In communication with the wireless logic (e.g., processing circuitry), these low profile antennas allow a wireless network device to achieve a thin, inconspicuous form factor.

In one embodiment, the antenna array assembly may be encapsulated within a wireless network device, such as an Access Point (AP) for example, where design requirements placed on the AP may impose certain size constraints on the antenna array assembly. For example, design constraints may require that the height of any antenna included in the antenna array be a maximum height of eleven millimeters (mm) as measured from the ground plane. In a second embodiment, any antenna included in the antenna array may be limited to a maximum height of ten millimeters as measured from the ground plane.

I. Terminology

In the following description, certain terminology is used to describe features of the disclosure. For example, the term "logic" is generally defined as hardware and/or software. As hardware, logic may include circuitry such as processing circuitry (e.g., a microprocessor, a programmable gate array, a controller, an application specific integrated circuit, controller, etc.), wireless receiver, transmitter and/or transceiver circuitry, semiconductor memory, decryption circuitry, and/or encryption circuitry.

A "wireless network device" generally represents an electronic unit that supports wireless communications such as an Access Point (AP), a bridge, a data transfer device (e.g., wireless network switch, wireless router, router, etc.), or the like.

An "interconnect" is generally defined as a communication pathway established over an information-carrying medium. This information-carrying medium may be a physical medium (e.g., electrical wire, optical fiber, cable, bus traces, etc.), a wireless medium (e.g., air in combination with wireless signaling technology), or a combination thereof.

The term "circular polarization" of an antenna may be defined as the polarization of an antenna having a radiofrequency (RF) signal that is split into two equal amplitude components that are in phase quadrature (at 90 degrees) and are spacially oriented perpendicular to each other and to the direction of propagation.

The term "elliptical polarization" of an antenna may be defined as the polarization of an antenna having a RF signal that has deviated from being circularly polarized. For example, an elliptically polarized antenna may transmit a RF signal having two components that are not equal in amplitude, are not in phase quadrature and/or are not spacially orthogonal.

The term "linear polarization" of an antenna may be defined as the polarization of an antenna having a RF signal wherein the phase difference of one component of the RF signal is equal to zero. The term "vertical polarization" of an antenna may be defined as a linearly polarized antenna having an electric field that is directed 90 degrees away from the earth's surface. In contrast, the term "horizontal polarization" of an antenna may be defined as a linearly polarized antenna having an electric field that is directed parallel to the earth's surface. A linearly polarized antenna may have an electric field that is directed at an angle other than 90 degrees away from the earth's surface (for example, 88 degrees away from the earth's surface).

Lastly, the terms "or" and "and/or" as used herein are to be interpreted as inclusive or meaning any one or any combination. Therefore, "X, Y or Z" or "X, Y and/or Z" mean "any of the following: X; Y; Z; X and Y; X and Z; Y and Z; X, Y and Z." An exception to this definition will occur only when a combination of elements, functions, steps or acts are in some way inherently mutually exclusive.

Certain details are set forth below in order to provide a thorough understanding of various embodiments of the disclosure, albeit the invention may be practiced through many embodiments other that those illustrated. Well-known logic and operations are not set forth in detail in order to avoid unnecessarily obscuring this description.

II. Network Architecture

Referring to FIG. 1, an exemplary embodiment of a network 100 implemented with a wireless network device 110 deploying an antenna array assembly 150 is shown. In accordance with one embodiment of the disclosure, network 100 operates as a wireless local area network (WLAN) that features one or more wireless network devices, such as access points (APs) 110-112 for example.

Although not shown, AP 110 may comprise logic, implemented within a cover 120, that controls wireless communications with other wireless network devices $\mathbf{130}_1$-$\mathbf{130}_r$ (where r≥1, r=3 for this embodiment) and/or wired communications over interconnect 140. Although not shown, the interconnect 140 further provides connectivity for network resources such as servers for data storage, web servers, or the like. These network resources are available to network users via wireless network devices $\mathbf{130}_1$-$\mathbf{130}_r$ of FIG. 1, albeit access may be restricted. It should be noted that the cover 120 shown in FIG. 1 is only an illustrative embodiment. The mold of the cover 120 may take any shape or form and may also be subject to design constraints regarding, in particular, size and heat dissipation.

More specifically, for this embodiment of the disclosure, each AP 110-112 supports bi-directional communications by receiving wireless messages from wireless network devices $\mathbf{130}_1$-$\mathbf{130}_r$ within its coverage area. For instance, as shown as an illustrative embodiment of a network configuration, wireless network device $\mathbf{130}_1$ may be associated with AP 110 and communicates over the air in accordance with a selected wireless communications protocol. Hence, AP 110 may be adapted to operate as a transparent bridge connecting together a wireless and wired network.

Of course, in lieu of providing wireless transceiver functionality, it is contemplated that AP 110 may only support unidirectional transmissions thereby featuring only receive (RX) or transmit (TX) functionality.

The antenna array assembly 150 is shown to include a plurality of antennas, illustrated as dashed rectangular objects. The configuration of the antennas on the antenna array assembly 150 comprises one embodiment of locations in which each antenna of the plurality of antennas may be placed. It is contemplated that the antenna array assembly 150 may be configured in accordance with an alternative antenna pattern, namely alternative locations for one or more of the plurality of antennas, without departing from the spirit and scope of the claimed invention.

III. Wireless Network Device with Antenna Array Assembly

Figure 2:
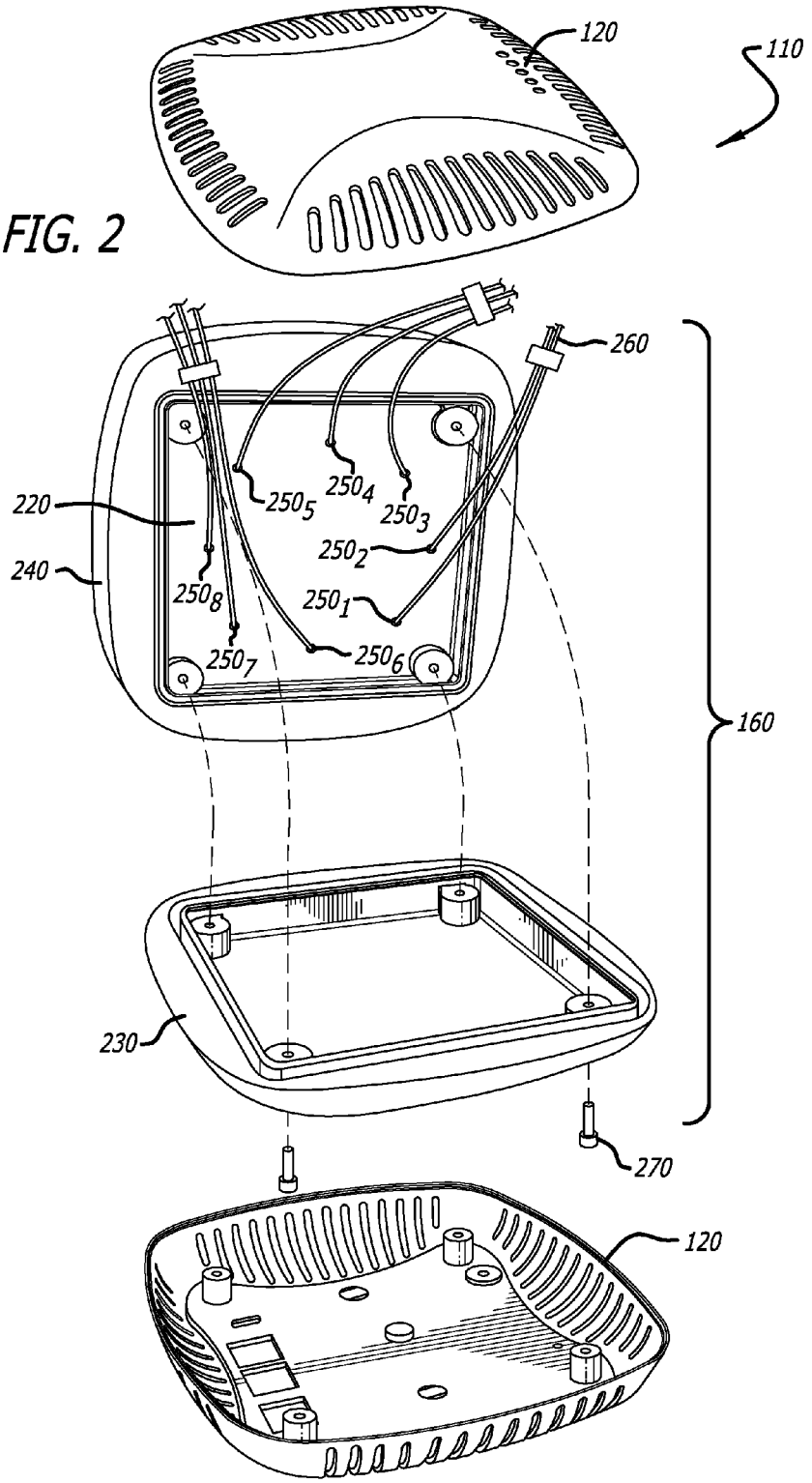
FIG. 2 is an exploded view of a first exemplary embodiment of the wireless network device of FIG. 1.

Referring now to FIG. 2, an exploded view of an exemplary embodiment of wireless network device 110 (e.g., AP 110) of FIG. 1 is shown. Herein, AP 110 comprises a cover 120 that encloses a housing 160 that includes the antenna array assembly 150. According to this embodiment of the disclosure, the housing 160 comprises a base section 230 and a cover section 240. The base section 230 and the cover section 240 may be secured by one or more fastening elements 270 (e.g., boss and screw/bolt, lock and insertion pin, light adhesive, etc.). The underside 220 illustrates the underside portion of the ground plane of the antenna array assembly 150 shown in FIG. 3. The entry points $\mathbf{250}_1$-$\mathbf{250}_M$ (M≥1, M=8 for this embodiment) illustrate the points of entry through which one or more interconnects (e.g. cables) 260 enter the underside 220 in order to supply power to the antennas positioned atop the antenna array assembly 150, where the power is associated with data for wireless transmission. Although not illustrated in FIG. 2, the base section 230 may include wireless logic communicatively coupled to the antennas positioned atop the antenna array assembly 150. The wireless logic may receive data through electrical signals from the antennas via, for example, interconnects 260 and may transmit electrical signals to the antennas.

In one embodiment, both the base section 230 and the cover section 240 may be made of a heat-radiating material in order to dissipate heat by convection. For example, this heat-radiating material may include aluminum or any other metal, combination of metals or a composite that conducts heat.

Figure 3:
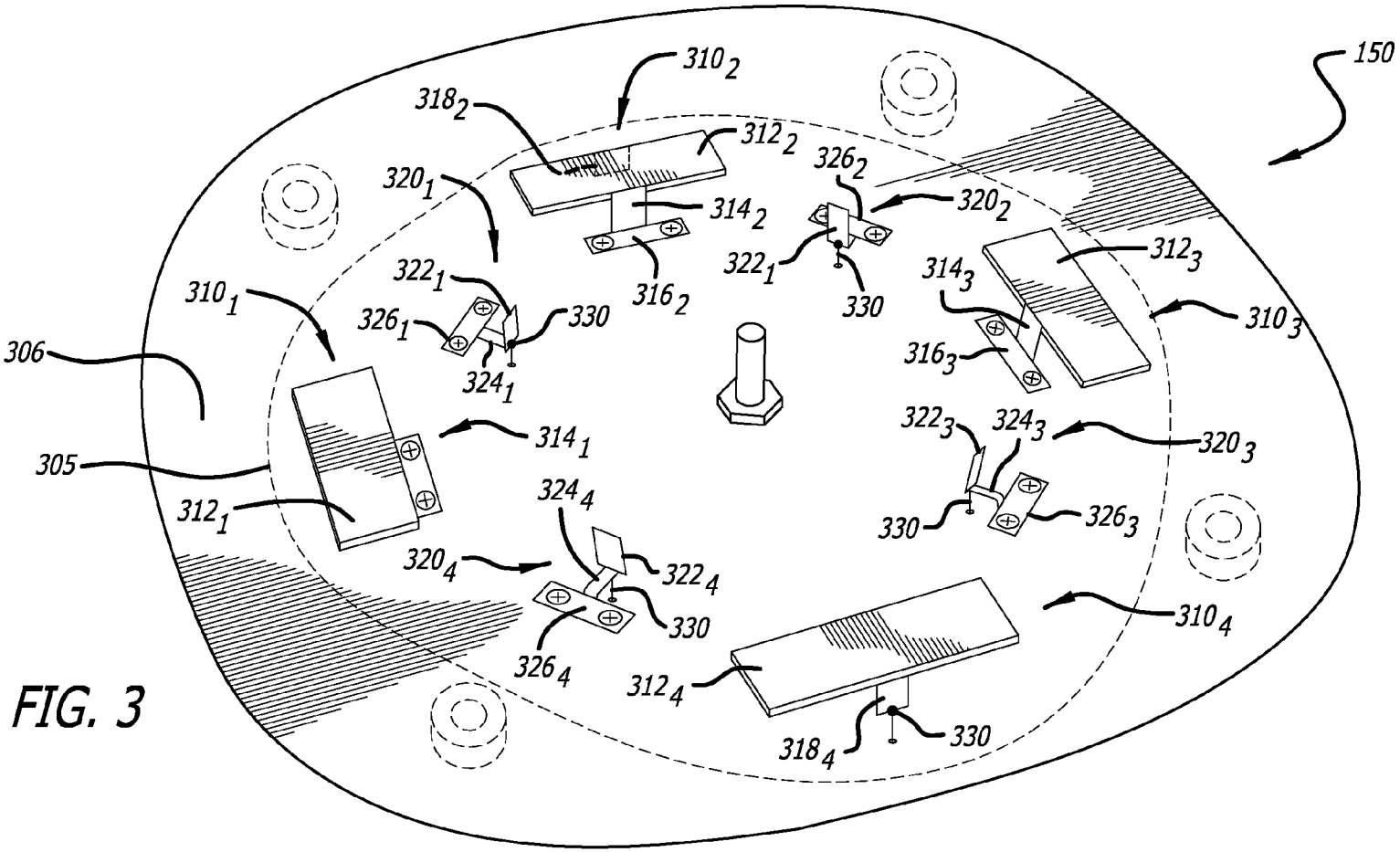
FIG. 3 is a perspective view of the topside of the antenna array assembly 150 positioned on the cover section 240 of the housing 160.

Referring to FIG. 3, a perspective view of the topside of the antenna array assembly 150 positioned on the cover section 240 of the housing 160 is shown. The antenna array assembly 150 includes an antenna array 305 and a ground plane 306. In this embodiment, two types of antennas are positioned on the topside of the antenna array assembly 150: (1) the semi-loop antennas $\mathbf{310}_1$-$\mathbf{310}_4$, and (2) the monopole antennas $\mathbf{320}_1$-$\mathbf{320}_4$. However, other embodiments may contain only one type of the above referenced antennas. A signal source is connected to each antenna via an interconnect such as the power cables 330 (e.g., similar to power cables 260 of FIG. 2) for example. Examples of a signal source may include, but are not limited or restricted to, a voltage source, a current source and/or wired or wireless logic supplying radio frequency data to be transmitted by one or more antennas. In the embodiment of FIG. 3, the semi-loop antennas $\mathbf{310}_1$-$\mathbf{310}_4$ and the monopole antennas $\mathbf{320}_1$-$\mathbf{320}_4$ are positioned in alternating fashion on the ground plane 306. Also, the monopole antennas $\mathbf{320}_1$-$\mathbf{320}_4$ may be positioned further from the edge of the ground plane 306 than the semi-loop antennas $\mathbf{310}_1$-$\mathbf{310}_4$. The power cables 330 supply current to the antennas that results in an excitation of electrons on each antenna (e.g., results in an electrical excitation). The current supplied to the antennas can be said to "electrically induce" the antennas. In one embodiment, both the semi-loop antennas $\mathbf{310}_1$-$\mathbf{310}_4$ and the monopole antennas $\mathbf{320}_1$-$\mathbf{320}_4$ may be vertically or elliptically polarized.

Each semi-loop antenna $\mathbf{310}_1$-$\mathbf{310}_4$ includes a top surface $\mathbf{312}_1$-$\mathbf{312}_4$, a first leg $\mathbf{314}_1$-$\mathbf{314}_4$, a base member $\mathbf{316}_1$-$\mathbf{316}_4$ and a second leg $\mathbf{318}_1$-$\mathbf{318}_4$. The base member $\mathbf{316}_2$ connects the semi-loop antenna $\mathbf{310}_2$ to the ground plane 306 of the antenna array assembly 150. The first leg $\mathbf{314}_2$ connects the top surface $\mathbf{312}_2$ to the base member $\mathbf{316}_2$. In the current embodiment, the length of the base member $\mathbf{316}_2$ is smaller than that of the top surface $\mathbf{312}_1$. The second leg $\mathbf{318}_2$ (positioned on a backside and better illustrated by second leg $\mathbf{318}_4$ of semi-loop antenna $\mathbf{310}_4$) is attached to the top surface $\mathbf{312}_1$ but does not come in contact with the ground plane 306 of the antenna array assembly 150. The power cable 330 connects to the second leg $\mathbf{318}_1$ to supply power to the semi-loop antenna $\mathbf{310}_1$. For each semi-loop antenna $\mathbf{310}_1$-$\mathbf{310}_4$, the power cables 330 are configured such that no connection is established between the second legs $\mathbf{318}_1$-$\mathbf{318}_4$ and the ground plane 306 through a physical medium.

Each monopole antenna $\mathbf{320}_1$-$\mathbf{320}_4$ includes a vertical surface $\mathbf{322}_1$-$\mathbf{322}_4$, a mount $\mathbf{324}_1$-$\mathbf{324}_4$ and a base member $\mathbf{326}_1$-$\mathbf{326}_4$. The base member $\mathbf{326}_1$ connects the monopole antenna $\mathbf{320}_1$ to the ground plane 306 of the antenna array assembly 150. The mount $\mathbf{324}_1$ connects the vertical surface $\mathbf{322}_1$ to the base member $\mathbf{326}_1$. The mount $\mathbf{324}_1$ is positioned above the ground plane 306. In one embodiment, the mount $\mathbf{324}_1$ may be positioned one millimeter above the ground plane 306. Alternatively, the mount may be may positioned at heights other than one millimeter above the ground plane 306. In one embodiment, the height of the vertical surface $\mathbf{322}_1$-$\mathbf{322}_4$ of each monopole antenna $\mathbf{320}_1$-$\mathbf{320}_4$ may affect the height of each mount $\mathbf{324}_1$-$\mathbf{324}_4$, respectively. The power cable 330 connects to the vertical surface $\mathbf{322}_1$ to supply power to the monopole antenna $\mathbf{320}_1$. However, the power cable 330 is configured such that no connection is established between the vertical surface $\mathbf{322}_1$-$\mathbf{322}_4$ and the ground plane 306 through a physical medium.

In one embodiment, the semi-loop antennas $\mathbf{310}_1$-$\mathbf{310}_4$ may be vertically or elliptically polarized and configured to operate on the 2.4 gigahertz (GHz) frequency band, while the monopole antennas $\mathbf{320}_1$-$\mathbf{320}_4$ may be vertically or elliptically polarized and configured to operate on the 5 GHz frequency band. Alternative embodiments may comprise an assortment of combinations of the antennas having different polarizations and/or operating on different frequency bands.

Figure 4A:
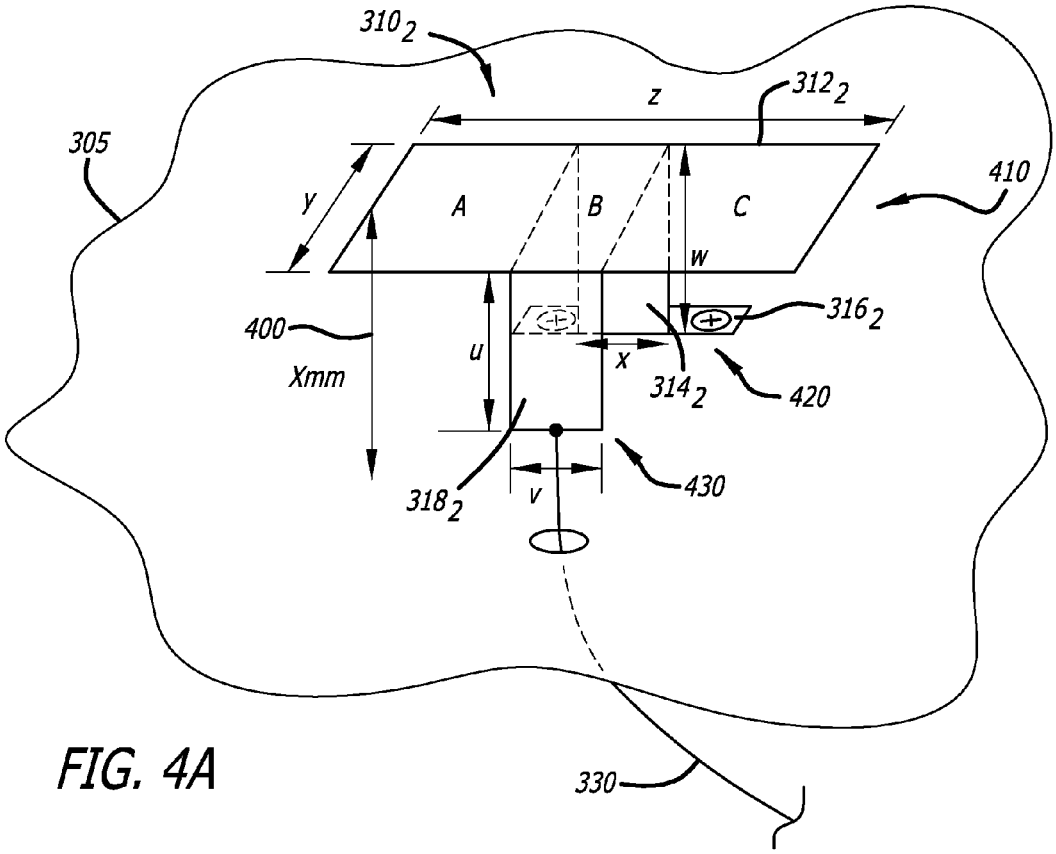
FIG. 4A is a perspective view of an exemplary embodiment of a semi-loop antenna $\mathbf{310}_2$.

Referring to FIG. 4A, a perspective view of an exemplary embodiment of one of the semi-loop antennas $\mathbf{310}_1$-$\mathbf{310}_4$, for instance, semi-loop antenna $\mathbf{310}_2$, is shown. The semi-loop antenna $\mathbf{310}_2$ may generate inductance from a semi-loop which includes the first leg $\mathbf{314}_2$ that is connected to the second leg $\mathbf{318}_2$ by the top surface $\mathbf{312}_2$.

Figure 4B:
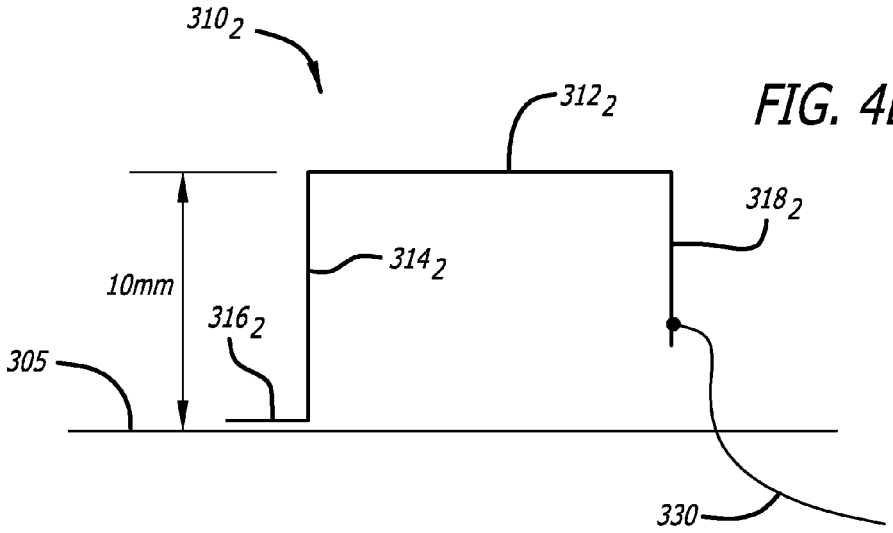

Referring to FIG. 4B, a profile view of the exemplary embodiment of the semi-loop $\mathbf{310}_2$ is shown. The profile view of FIG. 4B provides an illustration of the semi-loop that generates inductance. Furthermore, the profile view of FIG. 4B demonstrates that the semi-loop antenna $\mathbf{310}_2$ may be have a maximum height of ten millimeters as measured from the ground plane 305. In other embodiments, the maximum height 400 of the semi-loop antenna $\mathbf{310}_2$ may be greater than or less than ten millimeters, for example eleven millimeters or eight millimeters. In addition, the profile view of FIG. 4B illustrates that the second leg $\mathbf{318}_2$ does not establish a physical connection with the ground plane 305. As discussed above, the power cable 330, connected to a signal source, is configured such that no connection between the ground plane 305 and the second leg $\mathbf{318}_2$ is established.

The inductance created by the semi-loop causes a low profile semi-loop antenna, e.g., an antenna having a maximum height of ten millimeters or less, to effectively act as a short circuit. However, a low profile semi-loop antenna may be configured such that the semi-loop antenna also stores capacitance to match (e.g., cancel) the inductance created by the semi-loop. In at least one embodiment, the semi-loop antenna $\mathbf{310}_2$ may be configured such that the semi-loop antenna $\mathbf{310}_2$ does not rely on an element physically separate from the semi-loop antenna $\mathbf{310}_2$ to match the inductance created by the semi-loop. In other words, the semi-loop antenna $\mathbf{310}_2$ may be configured to match the inductance created by the semi-loop by designing the top surface $\mathbf{312}_2$, the first leg $\mathbf{314}_2$ and the second leg $\mathbf{318}_2$ as discussed herein.

Referring again to FIG. 4A, the top surface $\mathbf{312}_2$ extends laterally beyond its connection to the first leg $\mathbf{314}_2$ and the second leg $\mathbf{318}_2$. The top surface $\mathbf{312}_2$ is shown as having three sections: 'A'; 'B'; and 'C'. Section 'B' represents the section completing the semi-loop with the first leg $\mathbf{314}_2$ and the second leg $\mathbf{318}_2$. Sections 'A' and 'C' represent the sections of the top surface $\mathbf{312}_2$ that are configured to generate a capacitance corresponding to the inductance generated by the semi-loop antenna $\mathbf{310}_2$. A capacitance is stored between the top surface $\mathbf{312}_2$ and the ground plane 305. The amount of capacitance stored is determined by the area of the top surface $\mathbf{312}_2$ and the distance to the ground plane 305.

In at least one embodiment, the area 410 of the top surface $\mathbf{312}_2$ may be two or more times larger than the area of each of the first leg $\mathbf{314}_2$ and the second leg $\mathbf{318}_2$. As seen in the exemplary embodiment of FIG. 4A, the top surface $\mathbf{312}_2$ may have an area 410 equal to $Y \times Z$ $mm^2$ while the first leg $\mathbf{314}_2$ may have an area equal to $W \times X$ $mm^2$ and the second leg 423 may have an area 420 equal to $U \times V$ $mm^2$. In such an embodiment, $Y \times Z$ may be two or more times larger than $W \times X$ and $U \times V$, the area 430 of the second leg $\mathbf{318}_2$.

In at least one embodiment, the area 410 of the top surface $\mathbf{312}_2$ may be inversely proportional to the distance of the top surface $\mathbf{310}_2$ from the ground plane 305. In other words, as the lengths of the first leg $\mathbf{314}_2$ and the second leg $\mathbf{318}_2$ are reduced bringing the top surface $\mathbf{312}_2$ closer to the ground plane 305, the area 410 of the top surface $\mathbf{312}_2$ may increase. The ratio at which the total height of the semi-loop $\mathbf{310}_2$ and the area of the top surface $312_2$ are inversely proportional need not be a simple ratio. For instance, a decrease in the total height of the semi-loop antenna $310_2$ need only be accompanied by some increase in the area of the top surface $312_2$.

Referring to FIG. 4C, an exemplary circuit diagram representing the semi-loop antenna $310_2$ is shown. Signal source 440 supplies power to the semi-loop antenna $310_2$. The inductance created by the semi-loop is represented by inductance 460 while the capacitance created between the top surface $312_2$ and the ground plane 305 is represented by capacitance 450. As FIG. 4C illustrates, the inductance 460 and the capacitance 450 are in parallel. FIG. 4C may be represented as FIG. 4D. Referring to FIG. 4D, a second exemplary circuit diagram representing the semi-loop antenna $310_2$ is shown. The impedance 470 represents a parallel combination of the inductance 460 and the capacitance 450 of FIG. 4C.

In FIG. 4D, the impedance 470 is seen to have a value of 50 Ohms (Ω). The values of the capacitance 450 and the inductance 460 may be configured as to establish a value of 50Ω for the impedance 470. Alternatively, other values for the impedance 470 may be used. For example, the semi-loop antenna $312_2$ may be configured such that the values of the capacitance 450 and the inductance 460 may generate an impedance 470 having a value of 25Ω or 75Ω. Referring back to FIG. 4A, the portions A and C may be configured such that the impedance of the semi-loop antenna $310_2$ is equal to a predetermined value (25Ω, 50Ω, 75Ω, etc.). The dimensions of the top surface $312_2$ (area=length×width for a rectangle), including portions 'A', 'B' and 'C', is configured to obtain the desired impedance.

In one embodiment in which the semi-loop antenna $310_2$ is operating on a 2.4 GHz frequency, the relationship between the inductance (L) and the capacitance (C) generated by the semi-loop antenna $310_2$ can be described as:

$$2.4\ \text{GHz} = \frac{1}{2\pi\sqrt{LC}}$$

The above equation is used determine the inductance and capacitance while ensuring that the semi-loop antenna $310_2$ is operating at a resonant frequency of 2.4 GHz. Of course, other frequencies may be used if desired. For example, 5 GHz may be desired in some configurations.

In some embodiments, the top surface $312_2$ make take the form of shapes other than a rectangle. For example, the top surface $310_2$ may take the shape of any polygon. Referring to FIG. 5, another embodiment of a semi-loop antenna 520 includes a circular top surface 521, a first leg 522, a second leg 523 and a base member 534. A power cable 530 supplies power to the second leg 523. As with the rectangular top surface $312_2$ of the semi-loop antenna $310_2$ of FIG. 4A, a capacitance is stored between the circular top surface 521 and the ground plane 510.

Figure 6:
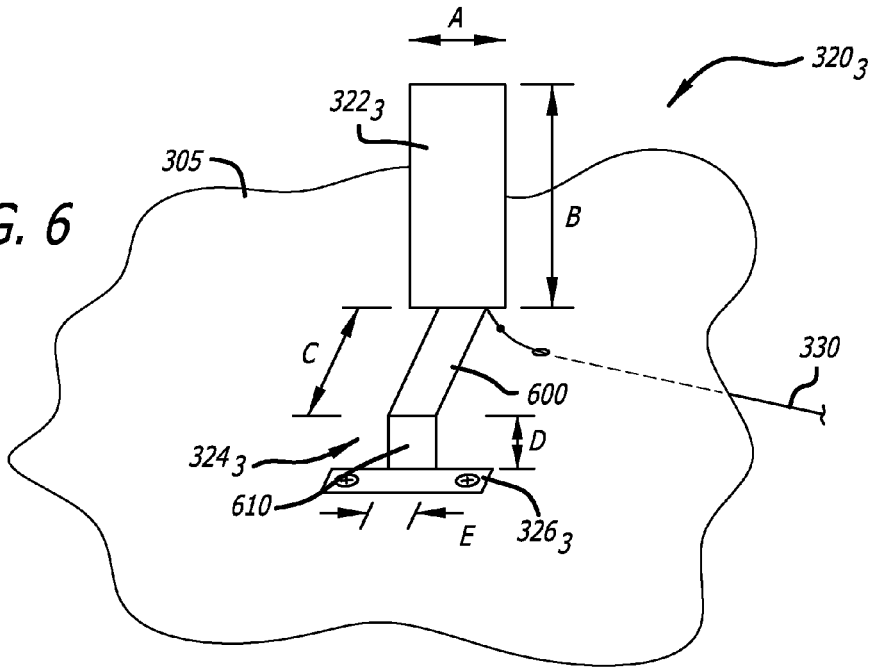
FIG. 6 is a perspective view of an exemplary embodiment of a monopole antenna 600.

Referring now to FIG. 6, a perspective view of an exemplary embodiment of one of the monopole antennas $320_1$-$320_4$ of FIG. 3, namely semi-loop antenna $320_3$, is shown. The monopole antenna $320_3$ includes a vertical surface $322_3$, a mount $324_3$ and a base member $326_3$. As illustrated in FIG. 6, the vertical surface $322_3$ has a width 'A' and a height 'B'. As discussed above, design constraints placed on an AP may limit various parameters of the antennas encapsulated within the AP. For example, the antennas may be limited to a maximum height of eleven millimeters. Alternatively, the antennas may be limited to a maximum height of ten millimeters. Therefore, as discussed below, the height 'B' of the vertical surface $322_3$ may be limited by the height of the mount $324_3$. For example, if the monopole antenna $320_3$ is restricted to a maximum height of ten millimeters and the mount 630 has a height of one millimeter, the vertical surface $322_3$ can have a maximum height 'B' of nine millimeters.

In addition, the monopole antenna $320_3$ is configured such that the vertical surface $322_3$ has no physical connection to the ground plane 305. The power cable 330 connects to the vertical surface $322_3$ to supply power to the monopole antenna $320_3$ but does not establish a connection between the vertical surface $322_3$ and the ground plane 305.

The mount $324_3$ includes a first portion 600 and a second portion 610. The first portion 600 connects to the vertical surface $322_3$ and the second portion 610 connects to the ground plane 305 via the base member $326_3$. In the embodiment of FIG. 6, both the first portion 600 and the second portion 610 are seen to have the same width, width 'E'. In one embodiment, the width 'E' may be two millimeters while in other embodiments, the width 'E' may be one millimeter or four millimeters for example. In other embodiments, the widths of the first portion 600 and the second portion 610 may not be equivalent. The first portion 600 has a length 'C' and the second portion 610 has a height 'D'. In one embodiment, the height 'D' may be one millimeter. In a second embodiment, the height 'D' may be four millimeters. The height 'D' represents the height of the mount as measured from the ground plane 305 and therefore also represents the height above the ground plane 305 that the vertical surface $322_3$ is positioned. Therefore, the total height of the monopole antenna $320_3$ above the ground plane is represented by the height 'D' in addition to the height 'B'.

In at least one embodiment, one dimension (e.g., length or width) of the vertical surface $322_3$ may be inversely proportional to at least one dimension of the mount $324_3$. In other words, as the height of the mount $324_3$ decreases at least one dimension of the vertical surface $322_3$ will increase. The ratio at which the height of the mount $324_3$ and the one or more dimensions of the mount $324_3$ are inversely proportional need not be a simple ratio. Additionally in some embodiments, a first dimension of the mount $324_3$ (e.g., length of the first portion 610) may be directly proportional to a second dimension of the mount $324_3$ (e.g., height of the second portion 610).

One goal of using a monopole antenna is to obtain a conical-shaped radiation pattern. One way to obtain the conical-shaped radiation pattern is to use a quarter-wavelength monopole antenna. In one embodiment, a vertically or elliptically polarized monopole antenna may operate on the 5 GHz frequency band. This means that a quarter-wavelength monopole has a height of approximately 15 millimeters. However, the maximum height of the monopole antenna may be limited by design constraints placed on the AP in which the monopole antenna is encapsulated. For example, a maximum height restriction of ten millimeters may be placed on the monopole antenna thereby preventing the use of a monopole antenna having a height of 15 millimeters.

As illustrated in FIG. 6, the vertical surface $322_3$ may have a height of nine millimeters with a gap between the vertical surface $322_3$ and the ground plane 305 due to the mount $324_3$ having a height of one millimeter (and adhering to the design constraint of limiting the monopole antenna $320_3$ to a maximum height of ten millimeters). When the monopole antenna $320_3$ has a height less than 15 millimeters (while operating on the 5 GHz frequency band), the monopole antenna $320_3$ acquires a capacitive impedance. In at least one embodiment, the monopole antenna $320_3$ may be configured such that the monopole antenna $320_3$ does not rely on an element physically separate from the monopole antenna $320_3$ to match the capacitance created by the low profile vertical surface $322_3$. In other words, the monopole antenna $320_3$ may be configured to match the capacitance created by the low profile vertical surface $322_3$ by designing the vertical surface $322_3$ and the mount $324_3$ as discussed herein.

In order to tune out (e.g., cancel) the capacitive impedance, a shunt inductance may be included with the monopole antenna. The mount $324_3$ of the monopole antenna $320_3$ provides the shunt inductance to tune out the capacitive impedance obtained by the vertical surface $322_3$ having a height less than 15 millimeters (when operating on the 5 GHz frequency band). In one embodiment, the width 'A' of the vertical surface may be five millimeters, which allows the impedance of the monopole antenna $320_3$ to remain on the unity admittance circle of the Smith chart. The relationship between the inductance (L) and the capacitance (C) generated by the monopole antenna $320_3$ can be described as:

$$5\ \text{GHz} = \frac{1}{2\pi\sqrt{LC}}$$

The above equation is used determine the inductance and capacitance while ensuring that the monopole antenna $320_3$ is operating at a resonant frequency of 5 GHz. Of course, other frequencies may be used if desired. For example, 2.4 GHz may be desired in some configurations.

Figure 7A:
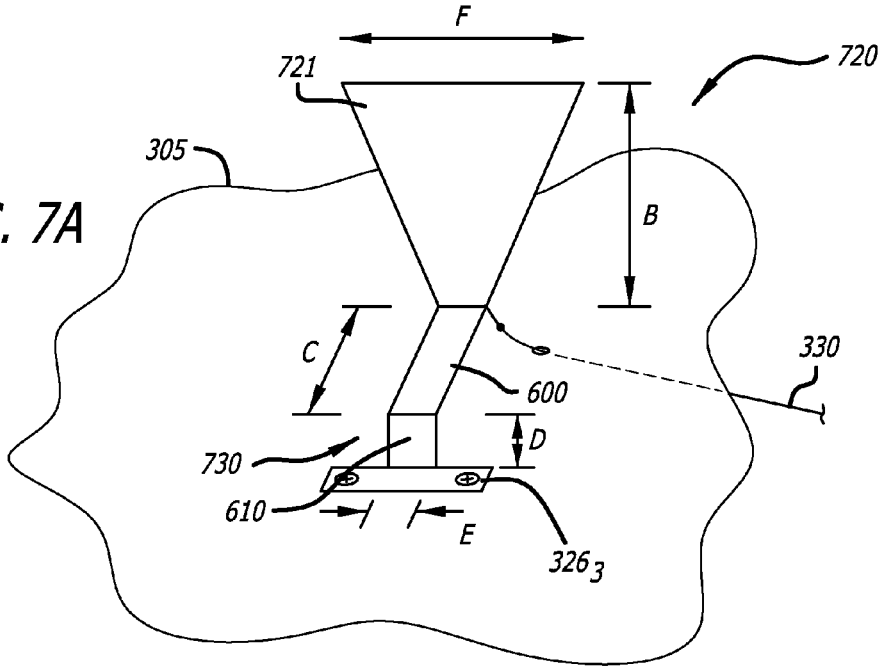
FIGS. 7A and 7B are illustrations of alternative exemplary embodiments of the monopole antenna 600 of FIG. 6.
Figure 7B:
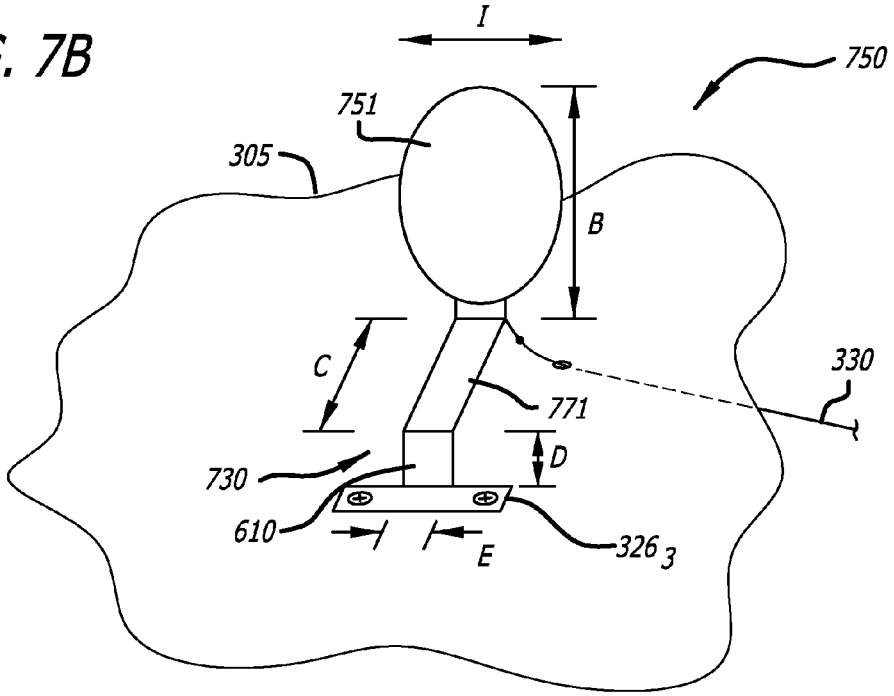

Referring now to FIGS. 7A and 7B, illustrations of alternative exemplary embodiments of the monopole antenna $320_3$ are shown. Referring to FIG. 7A, a monopole antenna 720 is seen to have a quadrilateral vertical surface 721: the top side of the vertical surface 721 has a length 'F'; the bottom side of the vertical surface has a length 'E'; and the vertical surface has a height 'B'. The mount 730 is the same as the mount $324_3$ depicted in FIG. 6. Referring to FIG. 7B, the monopole antenna 720 is seen to have a vertical surface 721 taking the shape of an ellipse. The major axis of the vertical surface 721 has a length 'B' (e.g., the height) while the minor axis of the vertical surface 721 has a length 'I'. The mount 730 is the same the mount $324_3$ as depicted in FIG. 6. The alternative embodiments of the vertical surfaces also generate a capacitance requiring the mount 730 to act as a shunt inductor in the same manner as discussed in accordance with FIG. 6.

Additional advantages and modifications will readily occur to those skilled in the art. Therefore, the disclosure in its broader aspects is not limited to the specific details and representative embodiments shown and described herein. Accordingly, various modifications may be made without departing from the spirit or scope of the general inventive concept as determined by the appended claims and their equivalents. The description is thus to be regarded as illustrative instead of limiting.

What is claimed is:

1. A device comprising:

a semi-loop antenna consisting essentially of:

a first section connected to a ground plane via a connection portion and extending away from the ground plane, a second section connected to an end of the first section, the second section being planar and facing the ground plane, and a third section connected to an end of the second section and extending toward the ground plane without coming into direct contact with the ground plane, wherein the third section is connected to a signal source via a connector, and an area of the second section and a distance of the second section from the ground plane are such that an inductance corresponding to the semi-loop antenna is canceled by a capacitance corresponding to the semi-loop antenna.

2. The device of claim 1, wherein the area of the second section and the distance of the second section from the ground plane are such that an impedance corresponding to the semi-loop antenna is 50 Ohms.

3. The device of claim 1, wherein the area of the second section and the distance of the second section from the ground plane are such that an impedance corresponding to the semi-loop antenna is 25 Ohms.

4. The device of claim 1, wherein the area of the second section and the distance of the second section from the ground plane are such that an impedance corresponding to the semi-loop antenna is 75 Ohms.

5. The device of claim 1, wherein the area of the second section is two or more times each of an area of the first section and an area of the third section.

6. The device of claim 1, further comprising:

a plurality of semi-loop antennas, including the semi-loop antenna, each consisting essentially of:

a first section connected to the ground plane via a connection portion and extending away from the ground plane, a second section connected to an end of the first section, the second section being planar and facing the ground plane, and a third section connected to an end of the second section and extending toward the ground plane without coming into direct contact with the ground plane; and a plurality of monopole antennas, wherein, for each of the plurality of semi-loop antennas:

the third section is connected to a signal source via a connector, and an area of the second section and a distance of the second section from the ground plane are such that an inductance corresponding to the respective semi-loop antenna is canceled by a capacitance corresponding to the respective semi-loop antenna, and the plurality of semi-loop antennas and the plurality of the monopole antennas are arranged in an alternating pattern on the ground plane.

7. The device of claim 6, wherein each of the plurality of monopole antennas is closer to a center of the ground plane than each of the plurality of semi-loop antennas.

8. A device comprising:

a monopole antenna consisting essentially of:

a first section connected to a ground plane via a connection portion and extending away from the ground plane, a second section connected to an end of the first section, the second section being planar and facing the ground plane, and a third section connected to an end of the second section and extending away from the ground plane, wherein the third section is connected to a signal source via a connector without the third section coming into direct contact with the ground plane, and a height of the first section, a length of the second section, and dimensions of the third section are such that a capacitance corresponding to the monopole antenna is canceled by an inductance corresponding to the monopole antenna.

9. The device of claim 8, wherein the height of the first section, the length of the second section, and the dimensions of the third section are such that an impedance corresponding to the monopole antenna is 50 Ohms.

10. The device of claim 8, wherein the height of the first section, the length of the second section, and the dimensions of the third section are such that an impedance corresponding to the monopole antenna is 25 Ohms.

11. The device of claim 8, wherein the height of the first section, the length of the second section, and the dimensions of the third section are such that an impedance corresponding to the monopole antenna is 75 Ohms.

12. The device of claim 8, wherein a highest point of the third section relative to the ground plane is no more than 15 millimeters from the ground plane.

13. The device of claim 8, wherein a length of the third section is less than or equal to 11 millimeters.

14. The device of claim 8, further comprising:

a plurality of monopole antennas, including the monopole antenna, each consisting essentially of:

a first section connected to a ground plane via a connection portion and extending away from the ground plane, a second section connected to an end of the first section, the second section being planar and facing the ground plane, and a third section connected to an end of the second section and extending away from the ground plane; and a plurality of semi-loop antennas, wherein, for each of the plurality of monopole antennas:

the third section is connected to a signal source via a connector, and a height of the first section, a length of the second section, and dimensions of the third section are such that a capacitance corresponding to the monopole antenna is canceled by an inductance corresponding to the monopole antenna, and the plurality of semi-loop antennas and the plurality of the monopole antennas are arranged in an alternating pattern on the ground plane.

15. The device of claim 14, wherein each of the plurality of monopole antennas is closer to a center of the ground plane than each of the plurality of semi-loop antennas.

* * * * *